United States Patent [19]

Nakamura

[11] 4,422,777

[45] Dec. 27, 1983

[54] TIME CORRECTING DEVICE FOR TIME SIGNALLING TIMEPIECE

[75] Inventor: Norihiko Nakamura, Saitama, Japan

[73] Assignee: Rhythm Watch Co., Ltd., Tokyo, Japan

[21] Appl. No.: 388,692

[22] Filed: Jun. 15, 1982

[30] Foreign Application Priority Data

Jun. 16, 1981 [JP] Japan ..... 56-88332[U]

[51] Int. Cl.[3] ..... G04B 17/12

[52] U.S. Cl. ..... 368/185; 368/243; 368/252

[58] Field of Search ..... 368/184, 185, 243, 252

[56] References Cited

U.S. PATENT DOCUMENTS

| | | | |
|---|---|---|---|
| 3,766,730 | 10/1973 | Kishida et al. | 368/185 |
| 3,972,178 | 8/1976 | Begnin | 368/185 |
| 4,351,043 | 9/1982 | Ogihara et al. | 368/252 |

*Primary Examiner*—Ulysses Weldon

*Attorney, Agent, or Firm*—Koda and Androlia

[57] ABSTRACT

A time correcting device for a time signalling timepiece including a time striking construction having an hour wheel pipe onto which an hour hand is attachingly pushed and a rotation detector linked to the rotation of the hour wheel pipe to control signalling numbers of a time striking device, an hour wheel inserted onto the hour wheel pipe with clearance, a click disc formed on the either one of the hour wheel pipe or the rotation detector in the time striking construction or said hour wheel, and a click apparatus facing to the click disc and fixed to the either other one of the hour wheel pipe, the rotation detector or the hour wheel, whereby the click action between the click disc and the click apparatus enables the intermittent rotation between the hour wheel pipe and the hour wheel so that the direct time correction on the hour hand can be performed with separation from a minute hand.

5 Claims, 9 Drawing Figures

TIME CORRECTING DEVICE FOR TIME SIGNALLING TIMEPIECE

BACKGROUND OF THE INVENTION

1. Field of the Invention

This invention relates to a time correcting device for a time signalling timepiece, and more particularly to a time correcting device for a time signalling timepiece which enables separate and direct correction of an hour hand and a minute hand by a finger, etc.

2. Description of the Prior Art

Generally, in time signalling timepieces having such time signalling functions as time striking, Westminster Chime, pigeon jumping-out, etc. a minute hand and an hour hand are directly rotated by a finger when a timepieces is required for time correction, in other words, front correction is performed.

However, since the reduction ratio between an hour wheel and a center wheel differentiate the rotating speed, the hour hand and the minute hand are happened be moved at the same time in error, when the minute hand is overlapped upon the hour hand, and, as a result, the hour wheel slips out of the right position on an hour wheel pipe as well as the tooth portion of the hour wheel and the minute wheel gets broken.

In order to avoid the above mentioned happening the improved conventional time correction device for the timepiece is constructed in such a way that the clicking action between a click apparatus and click holes enables separate correction of the hour hand and the minute hand, wherein the click apparatus is attached so as to solidly rotate with the minute wheel and the click holes are perforated through the minute wheel so that the click apparatus can engage with the click holes of the minute wheel.

Therefore, according to the prior art device, the intermittent slip rotation of the minute wheel enables correction of the hour hand without any rotation of the minute wheel.

However, since the minute wheel slowly rotates once per three or four hours, small numbers of click holes, that is, three or four, must be perforated so that the click action can be performed at one hour unit. Accordingly, each of the click holes is perforated far away from each other, and there arises a case that the click apparatus stays unstable between the respective click holes. When the time indicating gear train is driven in such state that the click apparatus is not engaged with a clock hole, the indicated hour time does not accord with the time signalling action.

it is also hard to assemble the hour wheel and the minute since the click holes are perforated at equal interval through the minute wheel for the purpose of firm time correction at one hour unit, and the right hour positions of the minute wheel and the hour wheel must be accorded each other.

Furthermore, in case of the time correction by means of rotating the hour hand by a finger, since the hour wheel drives to turn the minute wheel subordinately, the holding force of the hour wheel to the hour wheel pipe must be set stronger than the pressure of the click apparatus so that the hour wheel can be rotated against the pressure of the click apparatus. Consequently, there arise drawbacks that the hour wheel slips out of the right position in the hour wheel pipe and it is hard to dismantle and to assemble the timepiece.

SUMMARY OF THE INVENTION

Accordingly, it is the general object of the present invention to provide a time correcting device for a time signalling time piece which can be dismantled and assembled with ease and reliability, and enables hour hand time correction with easy and accuracy.

In keeping with the principles of the present invention the object is accomplished with a time correcting device for a time signalling timepiece which includes an hour wheel pipe assembly having an hour wheel pipe which an hour hand is attachingly pushed onto and a locking plate attached to the hour wheel pipe to control time signalling numbers of the time signalling device, an hour wheel inserted onto the hour wheel pipe with clearance, a click disc formed on the either one of the hour wheel pipe assembly or the hour wheel, and click apparatus facing to the click disc and fixed to the either other one of the hour wheel pipe assembly or the hour wheel, whereby the click action between the click disc and the click apparatus enables intermittent slip rotation between the hour wheel pipe assembly and the hour wheel so that direct time correction on the hour hand can be performed with separation from the minute hand.

BRIEF DESCRIPTION OF THE DRAWINGS

The above mentioned features and the object of the present invention will become more apparent from the following description made with reference to the accompanying drawings in which.

DESCRIPTION OF THE PREFERRED EMBODIMENTS

Figure 1:
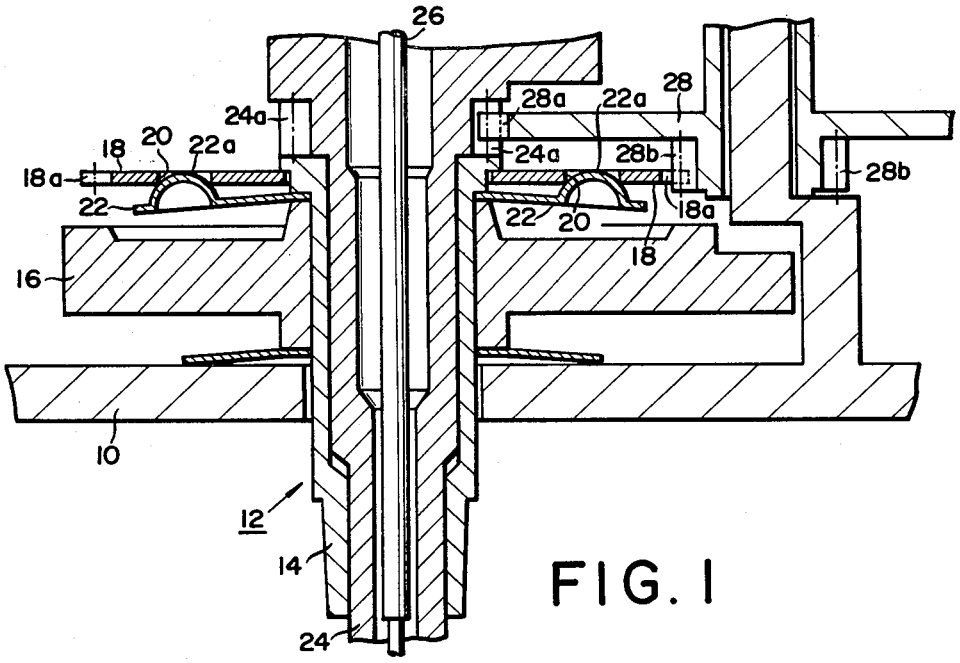
FIG. 1 is a section view showing the first preferred embodiment of a time correcting device for a time signalling timepiece in accordance with the teachings of the present invention.
Figure 2:
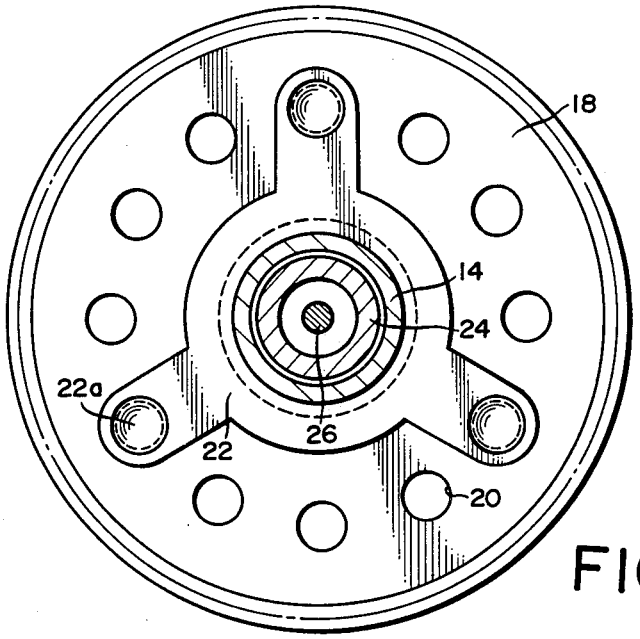
FIG. 2 is an illustration showing an engaging state between click holes and a click apparatus in the time correcting device for the time signalling timepiece in FIG. 1.

FIG. 1 shows the first preferred embodiment of a time correcting device for a time signalling timepiece having a mechanical time signalling control system in accordance with the teachings of the present invention. In FIG. 1 an hour wheel pipe assembly 12 built in the time indicating gear train is pivotally supported by a base plate 10. The above mentioned hour wheel pipe assembly 12 is also rotatingly supported by the base plate 10 and includes an hour wheel pipe 14, on the end of which an hour hand (not illustrated) is attached thereon, and a locking plate 16 which is pressed into the hour wheel pipe 14 to control the signalling numbers of the signalling device. An hour wheel 18 is inserted with clearance onto the hour wheel pipe 14.

In order to rotate the above mentioned hour wheel pipe assembly 12 and the hour wheel 18 with intermittend slip click holes 20 forming a click disk are perforated through the hour wheel 18 with 12 pieces corresponding to right hours from one o'clock through 12 o'clock. and a click apparatus 22 having three nail portions 22*a* is attached to the hour wheel pipe to engage with the above mentioned click holes 20. The nail portions 22*a* are formed in hemispherical state so that the nail portions 22*a* can firmly be engaged with the click holes 20. The click apparatus 22 is consisted of elastic material to thrust and urge onto the hour wheel 18 all the time and the rotation of the hour wheel pipe 14 enables the click action between the click holes 20 and the click apparatus 22. The nail portions 22*a* are positioned so that the locking plate 16 can come to the right hour position in such state that the nail portions 22*a* engage with the click holes 20.

In the mean time, a center wheel 24 is prepared in the hour wheel pipe 14, and further, a second arbour 26 is installed in the center wheel pipe 24. The teeth 28*a* of a minute wheel 28 pivotally supported by the base plate 10 are geared with a minute hand pinion 24*a* and the teeth 18*a* of the hour wheel 18 are geared with a minute wheel pinion 28*b*.

The first embodiment of the present invention is constructed as described above and its operation will be described hereinbelow.

Since the time signalling timepiece is assembled so that the click action can be performed between the click holes 20 perforated through the hour wheel 18 and the click apparatus 22 attached to the hour wheel pipe 14, the rotating force of the hour hand required to perform the click action becomes smaller in comparison with the prior art device. In other words, since the click means in the prior art device is attached to the minute wheel being geared with the hour wheel with increasing speed ratio, the hour hand must be rotated with large force to perform click action. In the present invention, however, the click action is performed between the hour wheel pipe 14 and the hour wheel 18, and the rotating force of the hour hand can be set smaller. Accordingly, the inserting press force of the hour hand and the hour wheel pipe 14 can be set smaller without looseness arising, and, as a result, the hour hand can be firmly an easily fixed to the hour wheel pipe 14.

Furthermore, in the prior art device, since small numbers of click holes, three or four pieces for example, are prepared in order to perform the time correction at one hour unit, the click apparatus stays unstable between the click holes and it is difficult to accord a right hour position of the minute wheel with a right hour position of the locking plate. In this embodiment, however, since 12 pieces of click holes 20 are perforated through the hour wheel 18 at equal interval corresponding to each of the right hour positions and it is unnecessary to accord the right hour position of the minute wheel with the right hour position of the locking plate as peformed in the prior art device, the timepiece can be assembled with ease.

In time correcting operation of the time signalling timepiece a corrector directly rotates the hour hand attached on the top of the hour wheel pipe 14 by a finger, but the minute hand does not move at this time. By rotating operation of the hour hand the nail portions 22*a* of the click apparatus 22 attached on the hour wheel pipe 14 slide over the hour wheel 18 at the hemispherical portions and by engaging the click apparatus 22 with the click holes 20 the rotating position of the locking plate 16 is set to accord with the right hour position. As mentioned above, the click action in accordance with the rotating operation of the hour hand between 12 pieces of the click holes 20 perforated through the hour wheel 18 corresponding to each of the right hour positions and the click apparatus attached to the hour wheel pipe 14 ensures the time correction at one hour unit with ease.

Figure 3:
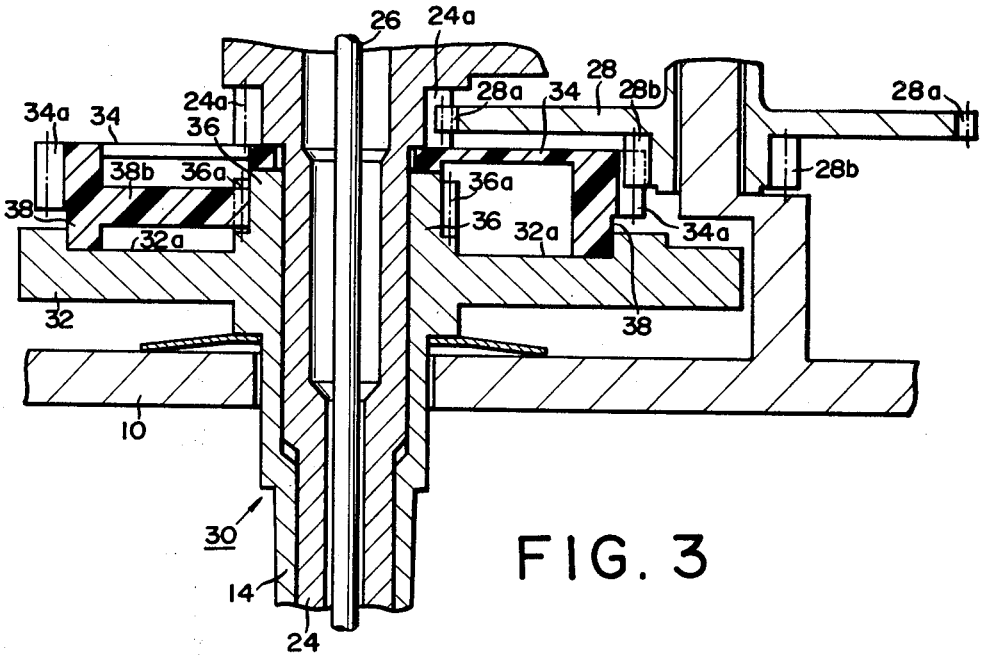
FIG. 3 is a section view showing the second preferred embodiment of a time correcting device for a time signalling timepiece in accordance with the teachings of the present invention.

FIG. 3 shows the second preferred embodiment of a time correcting device for a time signalling timepiece in accordance with the teachings of the present invention, and like elements with the first embodiment described above are denoted like referenced numerals.

In FIG. 3, an hour wheel pipe assembly 30 built in the time indicating gear train is installed through the base plate 10, and includes the hour wheel pipe 14 which is rotatingly and pivotally supported by the base plate 10 and a locking plate 32 which is solidly molded with the hour wheel pipe 14, and further, an hour wheel 34 is inserted onto the hour wheel pipe 14 with clearance.

Figure 4:
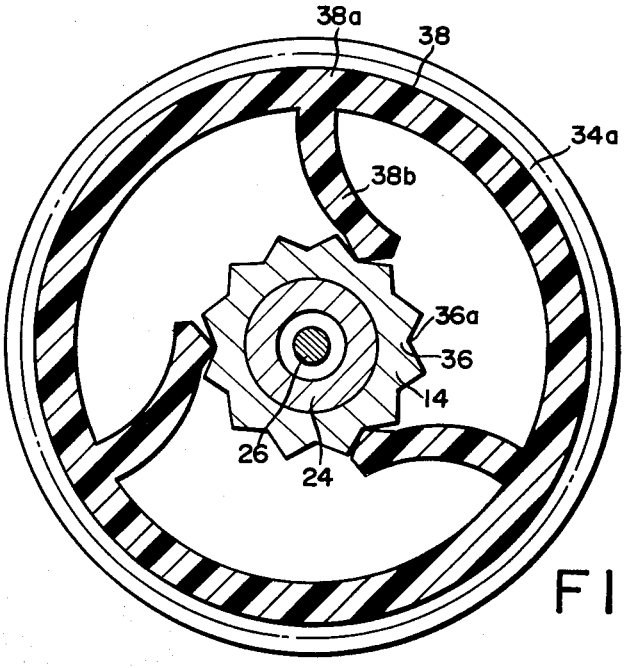
FIG. 4 is an illustration showing an engaging state between a click disc and a click apparatus in the time correcting device for the time signalling timepiece in FIG. 3.

In order to enable the intermittent slip rotation between the hour wheel pipe assembly 30 and the hour wheel 34 a click wheel 36 facing the click disc is prepared around the hour wheel pipe assembly 30 side and a click apparatus 38 is prepared on the hour wheel 34 side. In other words, as shown in FIG. 4, the click wheel 36 having 12 pieces of teeth 36*a* corresponding to each of the right hours from one o'clock through 12 o'clock is solidly molded with the hour wheel pipe 14. On the other hand, the click apparatus 38 performing click action in cooperation with the above mentioned click wheel 36 is solidly molded with the hour wheel 34. The click apparatus 38 includes a ring shaped base 38*a* which is inserted with clearance into a concave portion 32*a* of the locking plate 32 and three nail portions 38*b* which are fixed inside of the base 38*a* mentioned above to engage with the click wheel 36 also mentioned above. The nail portions 38*b* are manufactured by elastic to thrust and urge toward the click wheel 36 all the time, and the rotation of the hour wheel pipe 14 enables the click action between the click disc 36 and the click apparatus 38. As shown in FIG. 4, the nail portions 38*b* are positioned so that the locking plate 32 can come to the right hour position in such state that the nail portion 38*b* engage with the teeth 36*a*.

In the mean time, as described with the first embodiment, the center wheel pipe 24 is prepared in the hour wheel pipe 14, and further, the second arbor 26 is installed in the center wheel pipe 24. The teeth 28*a* of the minute wheel 28 pivotally supported by the base plate 10 are geared with the minute hand pinion 24*a* and the teeth 34*a* of the hour wheel 34 are geared with the minute wheel pinion 28*b*.

The second embodiment of the present invention is constructed as described above and the same operation is performed as the first embodiment by the click action between the click wheel 36 prepared around the hour wheel pipe 14 and the click apparatus 38 prepared on the hour wheel 34.

In this embodiment, since the hour wheel pipe 14, the locking plate 32 and the click wheel 36 are solidly molded and the hour wheel 34 and the click apparatus 38 are solidly molded, the numbers of parts of the time correcting device can be reduced.

Furthermore, in this embodiment, since the click apparatus is prepared in the space determined by the click wheel 36 and the concave portion of the locking plate 32, the length along the axis direction can be set shorter than the one of the first embodiment.

Incidentally, in each of the above mentioned embodiments, described therein has been the case that 12 click holes 20 or the teeth 36*a* of the click wheel 36 respectively corresponding to each of the right hours are prepared. However, preparation of 24 or 48 click holes 20 or teeth 36*a* of the click wheel 36 enables the time correction at 30 minute unit or at 15 minute unit.

Furthermore, in the first embodiment, described therein has been the case that the click apparatus 22 is fixed to the hour wheel pipe 14, but the same effect can be obtained by solid molding of the click apparatus 22 and the hour wheel pipe 14.

Figure 5:
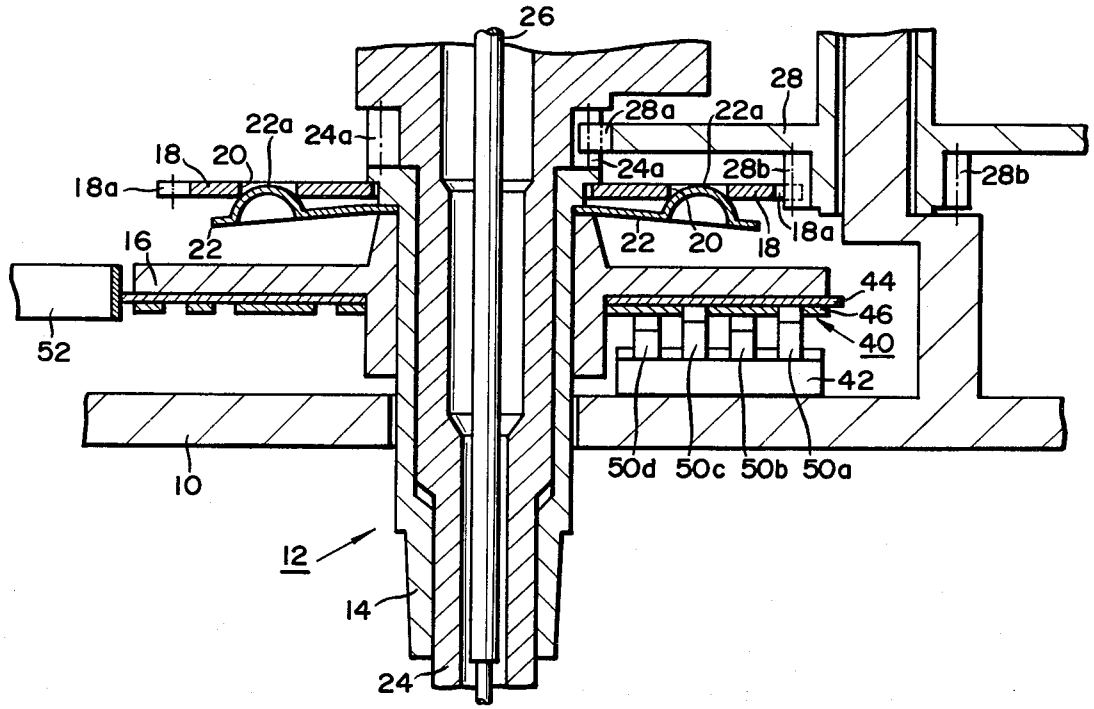
FIG. 5 is a section view showing the third preferred embodiment of a time correcting device for a time signalling timepiece in accordance with the teachings of the present invention.

FIG. 5 shows the third embodiment of the present invention, wherein an electric time signalling device is built in a timepiece. In FIG. 5, a rotatory detecting disc 40 is stuck below a locking rotator 16 and a fixed detector 42 is prepared to face with the above mentioned rotatory detecting disc 40 on the base plate 10.

Figure 6:
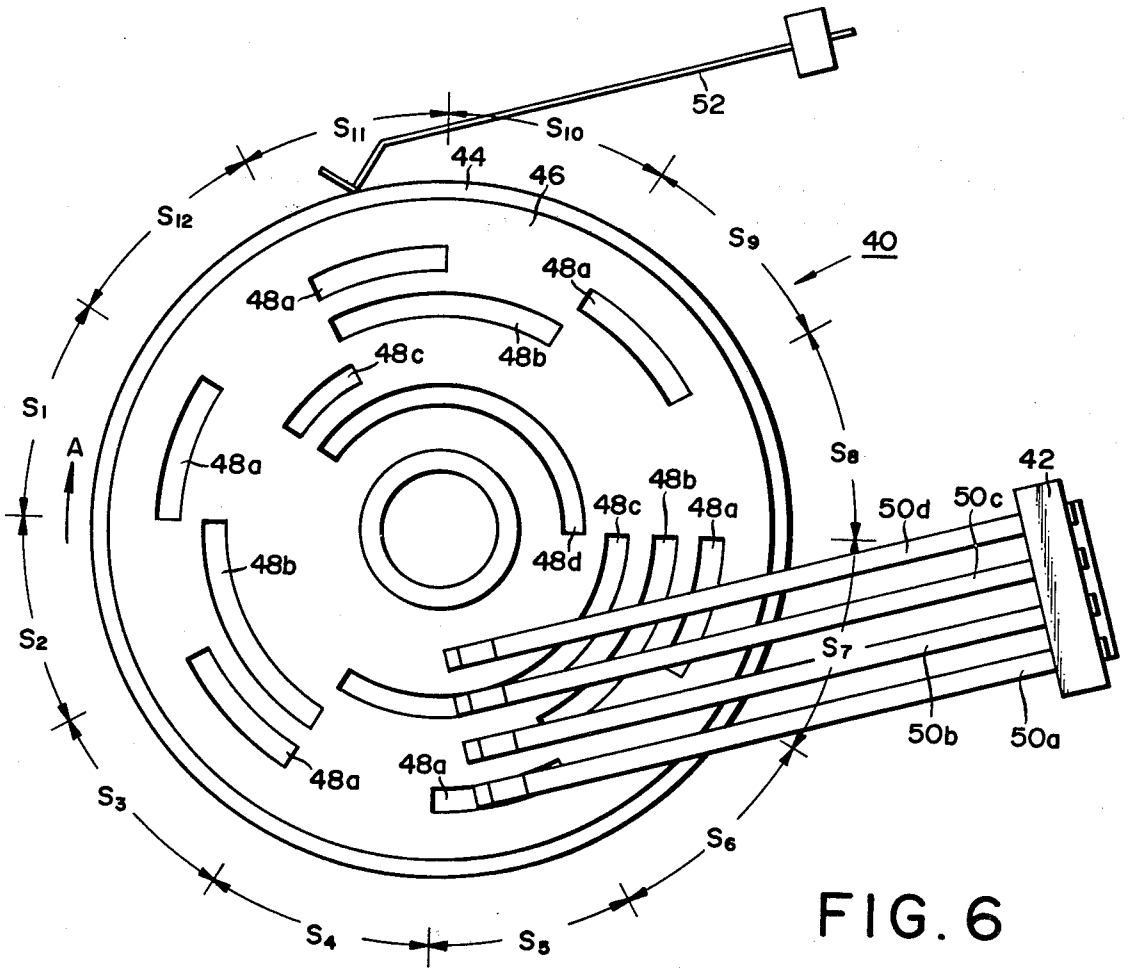
FIG. 6 is a plan view showing a mechanism of contact points in FIG. 5.

The rotatory detecting disc 40 is consisted of a conductive plate 44 and an insulating plate 46 is overlaid on the conductive plate 44 as shown in FIGS. 5 and 6. On the insulating plate 46 are formed contact slits 48*a*, 48*b*, 48*c* and 48*d* along four coaxial circle lines in order to make up contact points of the rotatory detecting disc 40. The insulating plate 46 is divided into the respective regions $S_1$, $S_2$,–, $S_{12}$ corresponding to one o'clock, two o'clock,–, 12 o'clock, and the contact slits 48*a*, 48*b*, 48*c* and 48*d* mentioned above are composed in circular arc shape and different in every one of the regions $S_1$, $S_2$,–, $S_{12}$. The relation between the contact slits 48*a*,–, 48*d* and the regions $S_1$,–, $S_{12}$, that is, the relation with the times from one o'clock through 12 o'clock is shown in FIG. 6. For example, a contact slit 48*a* is prepared only for a region $S_1$ corresponding one o'clock and a contact slit 48*c* is prepared only for a region $S_{12}$ corresponding to 12 o'clock.

The fixed detector 42 is prepared to detect the above mentioned contact slits 48*a*,–, 48*d* and has four contact brushes 50*a*, 50*b*, 50*c* and 50*d* which are respectively thrusted and urged to the contact slits 48*a*, 48*b*, 48*c* and 48*d*. In the vicinity of the circumference of the conductive plate 44 a fixed contact arm 52 is prepared to always touch with the conductive plate 44. Accordingly, when the rotatory detecting disc 40 rotates to the direction of arrow A as shown in Figure, the contact brushes 50*a*, 50*b*, 50*c* and 50*d* slip into the one or two more contact slits 48*a*, 48*b*, 48*c* and 48*d* to come in contact with the conductive plate 44 and the regions $S_1$,–, $S_{12}$, that is, one o'clock,–, 12 o'clock can be detected.

Figure 7:
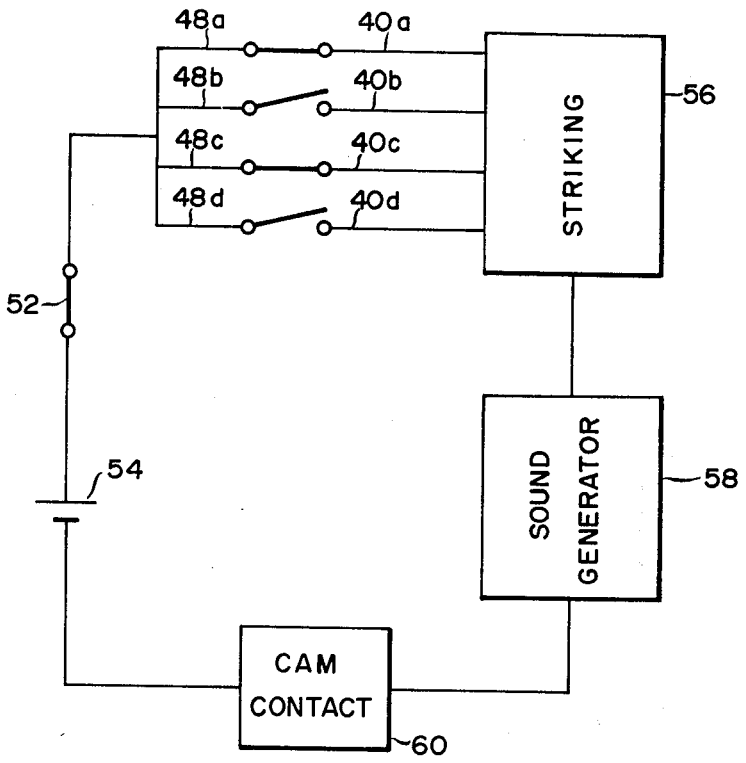
FIG. 7 is a circuit diagram preferred for the third embodiment.

FIG. 7 shows a circuit detecting time signalling numbers. This detecting circuit is consisted of a loop; a power source 54—the fixed contact arm 52—the contact slits 48—the contact brushes 50—a time striking circuit 56—a second generator 58—a cam contact 60—the power source 54. The time striking circuit 56 can detect which brush out of the brushes 50*a*,–, 50*d* comes in contact through the contact slits 48*a*,–, 48*d*. Table 1 shows the relation between the contact slits 48*a*,–, 48*d* and the times of one o'clock,–, 12 o'clock. The detection of "H" and "L" of the contact slits 48*a*,–, 48*d* ensures the time detection with accuracy.

As mentioned above, in the third embodiment, the time signalling numbers of the timepiece are electrically controlled at simple construction. In other words, as shown in FIG. 6, the rotatory detecting disc 40 rotates to the direction of arrow A. When the contact brushes 50*a* and 50*c* only fall into the contact slits 48*a* and 48*c* to come in contact with the conductive plate 44, the time striking circuits 56 in FIG. 7 detects the contacts. The time striking circuit 56, therefore, detects the rotatory detecting disc 40 positioning in the region $S_5$, that is, the time of five o'clock, and the sound generator signals "five o'clock".

As described heretofore, according to the third embodiment, the time signalling numbers are accurately controlled by the simple time signalling device.

Figure 8:
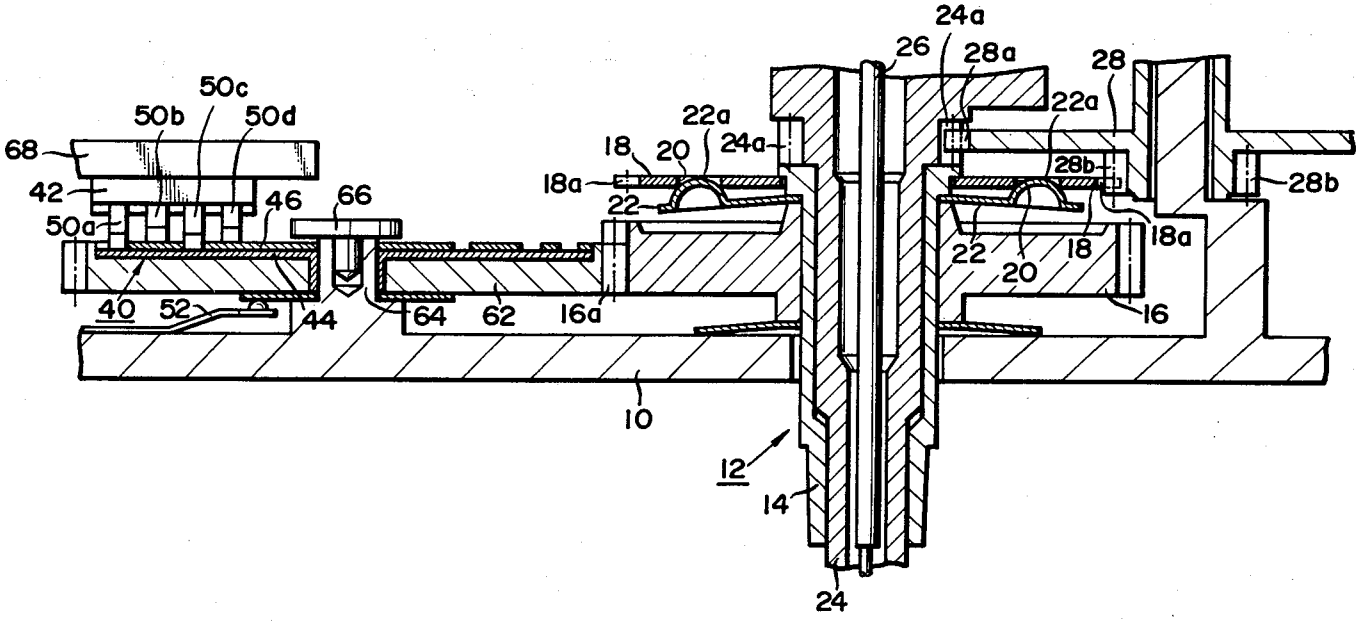
FIG. 8 is a section view showing the fourth preferred embodiment of a time correcting device for a time signalling timepiece in accordance with the teachings of the present invention.

Furthermore, FIG. 8 shows the fourth preferred embodiment of a time correcting device for a timepiece in accordance with the teachings of the present invention, and the click action is performed between the click holes 20 perforated through the hour wheel 18 and the click apparatus 22 fixed to the hour wheel pipe 14 in the same way as described in the first and the third embodiments.

In the said third embodiment, the rotatory detecting disc 40 is stuck and fixed below the locking rotator 16, but in the fourth embodiment the teeth 16*a* are formed around the circumference of the locking rotator 16 and the rotatory detecting disc 40 is stuck and fixed below a detecting wheel 62 which is geared with the teeth 16*a* of the above mentioned locking rotator 16. The detecting wheel 62 is rotatingly supported by a bearing 64 which is solidly molded with the base plate 10 and fastened by a bolt 66 which is pressed into the bearing 64. The above mentioned rotatory detecting disc 40 is stuck and fixed on the upper surface of the detecting wheel 62, and the fixed detector 42 is prepared on a base board 68 in order to face the rotatory detecting disc 40. Furthermore, the conductive plate 44 is extended onto the other side of the detecting wheel 62 to be always in contact with the fixed contact arm 52 prepared on the base plate 10.

Accordingly, in this embodiment, the time signalling numbers are also controlled with accuracy by the rotatory detecting disc 40 and the fixed rotator 42 in the simple time signalling device.

Furthermore, this embodiment enables a timepiece to get thinner along with the axis direction since the rotatory detecting disc 40 is not fixed below the locking rotator 16 but on the separate detecting wheel 62.

Figure 9:
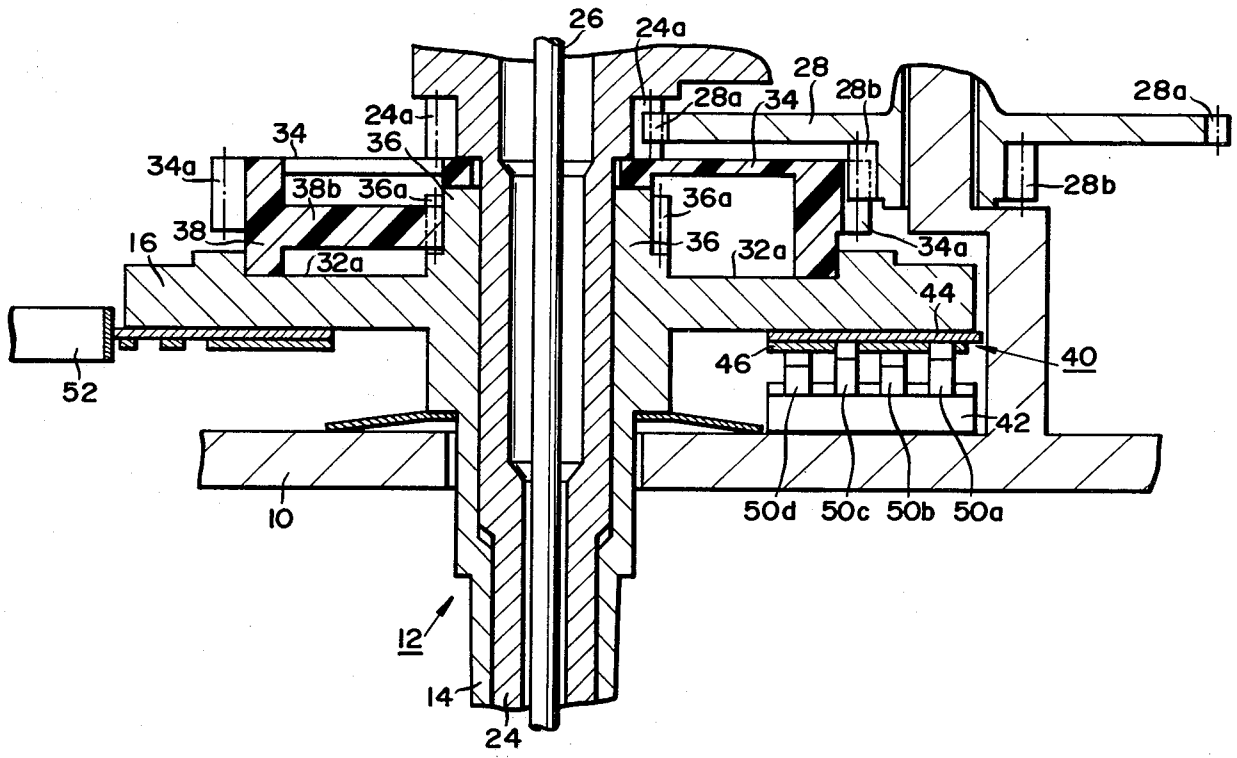
FIG. 9 is a section view showing the fifth preferred embodiment of a time correcting device for a time signalling timepiece in accordance with the teachings of the present invention.

FIG. 9 shows the fifth embodiment of the present invention. This embodiment is consisted of such construction that the contact device described in the third embodiment is attached to the locking plate 16 in the second embodiment. The corresponding like elements are denoted like numerals and the description is omitted.

As described heretofore, the present invention includes the click disc formed on the either one of the hour wheel pipe assembly or the hour wheel and click apparatus facing to the click disc and fixed to the either other one of the hour wheel pipe assembly or the hour wheel whereby the click action between the click disc and the click apparatus enables the intermittent slip rotation between the hour wheel pipe assembly and the hour wheel, and offers a time correcting device for a time signalling timepiece characterized in accurate and easy time correction by hour hand as well as firm and easy discomposition and assembly.

What we claim is:

1. A time correcting device for a time signalling timepiece comprising:

a time striking control construction having an hour wheel pipe;

an hour wheel inserted into said hour wheel pipe with clearance; and a click means coupled between said hour wheel pipe and said hour wheel, said click means comprising:

a click wheel having click teeth corresponding to each of the hour from one o'clock through twelve o'clock; and a click apparatus having at least one nail portion facing to said click wheel and said nail portion being engagable with said click teeth;

whereby the click action between said click wheel and said click apparatus enables the intermittent rotation between said hour wheel pipe and said hour wheel so that the direct time correction can be performed.

2. A time correcting device for a time signalling timepiece comprising:

a time striking control construction having an hour wheel pipe;

an hour wheel inserted into said hour wheel pipe with clearance; and a click means coupled between said hour wheel pipe and said hour wheel, said click means comprising:

a click wheel having click teeth which correspond to each of the hours from one o'clock to twelve o'clock; and a click apparatus having three nail portions facing to said click wheel and said nail portions being engagable with said click teeth;

whereby the click action between said click wheel and said click apparatus enables the intermittent rotation between said hour wheel pipe and said hour wheel so that the direct time correction can be performed.

3. A time correcting device for a time signalling timepiece according to claim 1 or 2 comprising a rotation detector linked to the rotation of said hour wheel pipe, said detector varying in accordance with the rotational position the signalling numbers of a time striking device.

4. A time correcting device for a time signalling timepiece according to claim 1, wherein said rotation detector comprises a detecting wheel.

5. A time correcting device for a time signalling timpiece according to claim 3 wherein said rotation detector comprises fixed brushes and a rotatory detecting disc having a plurality of contact points in circular arc shape which engage said fixed brushes.

* * * * *

UNITED STATES PATENT AND TRADEMARK OFFICE

CERTIFICATE OF CORRECTION

PATENT NO. : 4,422,777

DATED : December 27, 1983

INVENTOR(S) : Norihiko Nakamura

It is certified that error appears in the above—identified patent and that said Letters Patent is hereby corrected as shown below:

At [30] Foreign Application Priority Data, enter

--May 31, 1982 [JP] Japan . . . . . 57/80,366 [U]--

Signed and Sealed this

*Twenty-ninth* Day of *May 1984*

[SEAL]

*Attest:*

GERALD J. MOSSINGHOFF

*Attesting Officer* *Commissioner of Patents and Trademarks*